United States Patent [19]

Breithaupt et al.

[11] Patent Number: 4,651,715

[45] Date of Patent: Mar. 24, 1987

[54] METHOD FOR AN EQUIPMENT FOR MAKING DRY PRODUCTS FROM SUGAR SYRUP

[75] Inventors: Udo Breithaupt, Kerper-Horrem; Herta Benecke, Frechen-Grefrath, both of Fed. Rep. of Germany

[73] Assignee: Pfeifer & Langen, Cologne, Fed. Rep. of Germany

[21] Appl. No.: 706,535

[22] Filed: Feb. 27, 1985

[30] Foreign Application Priority Data

Feb. 29, 1984 [DE] Fed. Rep. of Germany ..... 3407374

[51] Int. Cl.[4] ..... F24C 1/14

[52] U.S. Cl. ..... 127/61

[58] Field of Search ..... 127/30, 58, 61

[56] References Cited

U.S. PATENT DOCUMENTS

| | | | |
|---|---|---|---|
| 3,972,725 | 8/1976 | Nicol | 127/30 |
| 4,162,927 | 7/1979 | Alvarez | 127/61 |
| 4,216,025 | 8/1980 | Monti | 127/61 |
| 4,290,818 | 9/1981 | Huber et al. | 127/61 |
| 4,342,603 | 8/1982 | Daniels | 127/61 |
| 4,468,409 | 8/1984 | Metroth | 127/61 |

*Primary Examiner*—R. B. Penland

*Attorney, Agent, or Firm*—Sprung Horn Kramer & Woods

[57] ABSTRACT

To convert syrups deriving from sugar production and other foodstuffs into a powder or granulated form subsequent to appropriate preliminary concentration and while preserving the product subject to the most extensive possible maintenance of the original composition, a sugar solution with at least 70% dry matter and up to 15% non-sucrose materials in the dry matter is brought by product-preserving rapid heating to a high temperature. Subsequently the vapors are allowed to escape to a dry-matter content of at least 90% and the thickened syrup is converted into a dry and pourable product just by cooling and sudden extraction of the residual water through crystallization. This preferably occurs in equipment comprising a steam-heated spiral-tube heat exchanger with a spiral tube that tapers out to 150 to 200% of its original free cross-section and has built-in twist generating baffles, a vapor precipitator to atmospheric pressure, and a crystallizer below the precipitator.

9 Claims, 1 Drawing Figure

METHOD FOR AN EQUIPMENT FOR MAKING DRY PRODUCTS FROM SUGAR SYRUP

DESCRIPTION

Exploiting the positive crystallization enthalpy of sucrose is known. Large volumes of sugar are produced in Brazil and Portugal for example by what is called the amorphous or Aerado process. The sugar solution is thickened batchwise in one or usually two heated containers, one downstream of the other and each equipped with powerful stirring mechanisms, until seed crystals demonstrate the initiation of crystallization, subsequent to which the residual water is evaporated and an amorphous-crystalline, freely flowing powder forms.

To utilize this transformation of the supersaturated sugar syrup in a continuous process, the syrup is subjected to continuous beating in order to initiate nucleation and break up the crystallizing sugar mass, with air being simultaneously blown in to dissipate the heat. The process necessitates complicated apparatus and a lot of energy (U.S. Pat. No. 3,365,331).

In another continuous process, supersaturated sugar syrup is subjected to a shearing force with a shear rate of at least 5000 cm/sec/cm to initiate a sudden and rapidly forced homogeneous nucleation, and crystallization is then allowed to proceed on its own. The requisite high shear forces are generated with complicated industrial equipment, high-speed colloid mills for example (German Pat. No. 2 516 253).

It has surprisingly turned out that, by carrying out special methods, not only can the costly apparatus for generating mechanical shear forces be eliminated but also the expensive boiling systems necessitated by the Brazilian amorphous process, including the high-performance stirring mechanisms, which are so energy-intensive because of the very high demand for force.

"Sugar," whether in the form of solution or syrup, is to be understood in what follows as meaning sucrose, which may contain up to 15% non-sucrose materials. Such as other types of sugar like grape sugar, fructose, malt sugar, glucose syrups, starch, dextrins, maltodextrin, cocoa, coffee, tea extracts, medicinal-tea extracts, extracts of tea-like products, fats, powdered milk, and fruit powder, flavoring acids like lactic, citric and racemic acids, common salt and other mineral salts, seasonings, colorants, and aromatics, or vitamins.

The invention is intended to convert both syrups deriving from sugar production and mixtures with other foodstuffs into a powder or granulated form subsequent to appropriate preliminary concentration and while preserving the product subject to the most extensive possible maintenance of the original composition, especially of the associated materials in the sugar solutions or syrup.

The object of the invention is a method of making dry products through the spontaneous crystallization of supersaturated sugar solutions, in which a sugar solution with at least 70% dry matter and up to 15% non-sucrose materials in the dry matter is brought by product-preserving rapid heating to a high temperature and by subsequently allowing the vapors to escape to a dry-matter content of at least 90% and in which the thickened syrup is converted into a dry and pourable product just by cooling and sudden extraction of the residual water through crystallization. The rapid heating to a high temperature is preferably carried out in a steam-heated forcible flow-through spiral tube. The sugar solution is brought thereby to a temperature of 135° to 155° C., depending on the content of non-sucrose materials, before the vapors escape. The temperature of the rapid heating and the content of dry matter that results therefrom subsequent to escape of the vapors and that is accompanied by spontaneous crystallization of the sucrose depend on the type and content of non-sucrose materials. When the syrups contain more than 95% sucrose in the dry matter, thickening to 90 to 94% will be sufficient. At a sucrose content of 85 to 95% in the dry matter, they should be evaporated to at least 94% and preferably to 96 to 97% dry matter.

The rapid and hence product-preserving thickening to the requisite high dry-matter content without partial supersaturation or superheating in a heat exchanger is made possible by the design-dictated satisfactory heat transition of the evaporator employed. Concentration occurs under atmospheric pressure in a steam-heated spiral tube that tapers out over its extent. The high rate of flow and the bubbles of steam that form ensure high heat transfer. The pump-governed forcible flow-through ensures short flow-through times of 60 seconds maximum, preventing the formation of caramelization products, which become apparent as the result of the sugar mass turning brown. Even the formation of invert sugar, which is otherwise to be feared in the heating of products that contain sugar because of its deleterious effect on shelf life, is below 1%.

Typical of the method is the comparatively high thickening of the syrup in an easily controlled forcibly charged single-tube spiral heat exchanger. The physical and thermal conditions are accordingly comparatively easier to define.

In addition to the brief flow-through time, the residence spectrum is very narrow, meaning that residence time is almost equal for each unit of volume. Even the channeling that is to be feared in other types of heat exchanger precisely at high viscosities is excluded. The concentration of the thickened syrup can accordingly be very high with practically no risk. Highly reproducible process parameters are also ensured in continuous operation.

Provisions are made for the vapors to escape at the exit from the spiral-tube evaporator. This will preferably occur in a separation space at atmospheric pressure. Deliberate cooling then initiates crystallization. At the temperature and concentration ranges in question, cooling of just 10° to 15° C. will cause sufficient supersaturation of the sugar syrup. The spontaneous crystallization triggered by the cooling will be apparent from foaming up of the sugar-containing mass as a result of the evaporation of the residual water. If the mass is to be conveyed on through pipelines, the crystallization reaction, which occurs within 30 to 60 seconds, necessitates the application of a preliminary pressure equal to the partial pressure of the water vapor to the pipelines to prevent crystallization or blockage as the result of separation of water vapor and solids. This will ensure, if the pipelines are also insulated or heated, that crystallization does not occur until the product emerges from the pipelines. This procedure is especially practical to ensure uniformly rapid cooling when either very high volumes of about 1500 liters/hour or more or very highly thickened syrups are to be uniformly applied to a belt conveyor.

The method in accordance with the invention accordingly makes it possible to eliminate adding triggering crystals as in the Aerado process or mechanically initiating nucleation with high shear forces.

The supersaturated sugar syrup with a dry-matter content of 90 to 97% can then, depending on the type and content of non-sucrose materials, be continuously metered out in any appropriate conveyor system, whereby it must be ensured that the water vapor that forms as the result of the exothermic reaction can escape. Appropriate are not only slow, open worm conveyors and belt conveyors but also vacuumized flight coolers, which should be cooled in the vicinity of termination of the crystallization phase in order to preserve the product. When belt conveyors are employed, it is also a good idea to heat the delivery point to prevent too much heat loss, which can lead to the formation of vitreous non-crystallizing melts.

When a steel belt is employed as a crystallizer for the thickened syrup, it is heated in the vicinity of transfer and cooled downstream. The transfer vicinity of the steel belt should be preliminarily heated to a temperature of about 60° to 40° C. below that of the thickened syrup. When the steel belt is too cool there is a risk of vitrification especially in the bottom layer, meaning that a uniformly microcrystalline-amorphous instant product will not form as desired. When the temperature is too high, crystallization will be retarded and the product will still be too warm upon leaving the crystallizer. The same holds for other types of crystallizer, like an open ribbon conveyor that is cooled downstream for example.

Characteristic of the products fabricated by the method in accordance with the invention is their microcrystalline structure. They will accordingly have an almost instantaneously dissolving behavior and, in cases of mixtures of sugar with other foodstuffs, excellent homogeneity.

In the production of more or less pure sugar the method in accordance with the invention is essentially less capital and energy intensive than conventional evaporation crystallization followed by centrifuging and will accordingly decrease overall product costs. Its gentle methodology also makes it possible in accordance with the invention to produce dry foodstuff mixtures with a high sucrose content and also heat-sensitive associated materials without the latter being chemically altered.

The method in accordance with the invention is preferably carried out with equipment of the type that will now be described with reference to the drawing which is a schematic flow sheet of an apparatus for carrying out the process.

In the drawing sugar solution is introduces at the bottom of a steam-heated heat exchanger 1 provided with a spiral tube 2 that tapers out to 150 to 200% of its original free cross-section. The tube 2 has built-in twist-generating baffles 3. The heated solution passes next to a vapor precipitator 4 which is at atmospheric pressure, water vapor going off overhead. Almost water-free sugar syrup drops onto an open ribbon conveyor 5 below the precipitator, the conveyor 5 being encased in a cooling jacket 6 at its downstream end.

The invention will be further described in the following illustrative examples:

EXAMPLE 1

Mother liquor from candy fabrication

| Composition | Syrup | Dry Product |
|---|---|---|
| d.m. | 70.2% | 98.8% |
| sucrose in d.m. | 94.2 | 93.8 |
| invert sugar in d.m. | 1.51 | 1.66 |
| conductivity ash in d.m. | 1.37 | 1.39 |
| pH | 5.9 | 5.7 |
| ICE (420 nm) | 34.600 | 35.100 |
| bulk density | | 340 g/— |

360 g/h of mother liquor from candy fabrication were preheated to 65° C., conveyed with a controlled-speed positive-displacement pump into single-tube spiral evaporator heated with steam at 4.6 bar, and heated to 142° C. within 40 to 45 seconds. The vapors were removed in a vapor-separation space and the thickened syrup transferred to a steel belt, the upstream quarter of which was heated to 80° to 85° C. and the downstream third of which was chilled. Intense foaming of the mass occurred within 1 minute at about 130° C. and, subsequent to a residence time on the belt totaling 6 minutes, the scaly product, dried to a residual moisture of 1.2% and already pourable, was removed at an unloading temperature of 30° to 40° C. The brown and rapidly soluble instant sugar can be processed further without any additional treatment and its flavor is far superior to that of the product fabricated by the conventional Brazilian amorphous process.

Output: 256 kg/h dry product.

EXAMPLE 2

Full-value sugar

| Composition | Syrup | Dry Product |
|---|---|---|
| d.m. | 71.% | 98.4% |
| sucrose in d.m. | 91.3 | 89.4 |
| invert sugar in d.m. | 3.48 | 4.3 |
| conductivity ash or sulphate ash in d.m. | 2.5 | 2.5 |
| raw protein in d.m. | 1.1 | 1.1 |
| pH | 5.4 | 5.5 |
| color in solution, ICE (420 nm) | 7185 | 7894 |
| EBC | 180 | 200 |
| vitamins (7 B vitamins) | 2.5 mg/ 100 g d.m. | 2.4 mg/ 100 g |

Produced as in Example 1 subject to the conditions: heating of 1250 kg/h of sugarcane juice thickened to 71% d.m. to 152° C. in about 40 sec at a hot-steam pressure of 6.5 bar, foam-up of sugar mass at about 140° C., residual moisture 1.6% at end of belt, removal temperature 40° C. The dry product was milled without additional drying into a freely flowing powder with a bulk density of 530 g/liter.

Yield: 902 kg/h.

EXAMPLE 3

Aid for sausage making 1100 kg/h of sugar solution with 72% dry material and contents of 92.8% sucrose and 7.2% of a mixture of curing salts (each in terms of dry material) were preheated to 75° C. and then, as described in Example 1, heated to 148° C. within 35 seconds at a hot-steam pressure of 5.9 bar. Subsequent to separation of the vapors, the thickened syrup was allowed to flow into a 7-m long ribbon conveyor open at the top and with a screw diameter of 0.8 m. The residual water had already almost evaporated after just about 40 seconds. Subsequent to passing through the conveyor, which had a cooling jacket that commenced at its midpoint, a homogeneous, freely flowing instant product with a water content of 0.12% percent and, in terms of the d.m.

0.09% invert sugar,
92.7 sucrose, and
7.2 curing-salts mixture
was obtained.

Yield: 793 kg/h.

EXAMPLE 4

Herb-tea powder 1050 kg of sugar solution with a total solid-material content of 70.5% at a content in terms of dry material of 88.05% sucrose, 10% grape sugar, 1.0% honey, and 0.95% herb-tea extract consisting of 20 extracts of herbs like peppermint, eucalyptus, chamomile, anise, etc., were heated, subsequent to preheating to 68° C. to 152° C. (hot-steam pressure of 6.5 bar) as described in Examples 1 through 3 and allowed to flow onto a ribbon conveyor as described in Example 3. The residual water evaporated in about 20 seconds subsequent to brief foam-up.

At the exit from the conveyor was a freely flowing instant product with 1.6% moisture that is directly usable subsequent to fine milling.

Yield: 752 kg/h.

It will be understood that the specification and examples are illustrative but not limitative of the present invention and that other embodiments within the spirit and scope of the invention will suggest themselves to those skilled in the art.

What is claimed is:

1. A method of making a dry pourable sugar product consisting of rapidly heating a sugar solution containing at least 70% dry matter and up to 15% non-sucrose material in the dry matter to a high temperature in less than 60 seconds, allowing water vapor to escape from the solution to produce a thickened syrup having a dry-matter content of at least 90%, and cooling sufficiently to initiate rapid crystallization of the thickened syrup thereby to form a dry and pourable product.

2. A method according to claim 1, wherein the rapid heating to a high temperature is carried out in a spiral tube with forcible flow-through.

3. A method according to claim 1, wherein the water vapor is allowed to escape in a separation space at atmospheric pressure.

4. A method according to claim 1, wherein before the escape of water vapor the sugar solution is rapidly brought to a temperature of 135° to 155° C.

5. A method according to claim 1, wherein the thickened syrup is cooled by at least 10° C. to crystallize it.

6. A method according to claim 1, wherein the thickened syrup is crystallized by allowing it to flow out of the space where vapor is separated.

7. A method according to claim 1, wherein the thickened syrup is crystallized by spraying.

8. A method according to claim 1, wherein the thickened syrup is deposited on a steel belt heated to about 40° to 60° C. below the temperature of the syrup in the transfer and vicinity and subsequently cooled downstream.

9. A method according to claim 1, wherein the starting sugar solution contains 75 to 85% dry matter, comprising up to 88% sucrose and at least 15% non-sucrose solids, is brought to 140° to 148° C. in about 40 to 50 seconds by rapid heating, the vapors are allowed to escape to result in a dry-matter content of at least 95%, and the thickened syrup is converted into an instant brown sugar by cooling 15° C. with sudden extraction of the residual water.

* * * * *

UNITED STATES PATENT AND TRADEMARK OFFICE

CERTIFICATE OF CORRECTION

PATENT NO. : 4,651,715

DATED : March 24, 1987

INVENTOR(S) : Udo Breithaupt, et al.

It is certified that error appears in the above-identified patent and that said Letters Patent is hereby corrected as shown below:

| | |
|---|---|
| Title Page, under "U.S. Patent Documents," line 6 | Delete "Metroth" and substitute --Metzroth-- |
| Title Page, last line | Delete "1 Drawing Figure" |
| Col. 6, line 29 | Before "vicinity" delete "and" |

Signed and Sealed this

Thirteenth Day of October, 1987

*Attest:*

DONALD J. QUIGG

*Attesting Officer*

*Commissioner of Patents and Trademarks*